US005571043A

United States Patent [19]

Lyras et al.

[11] Patent Number: 5,571,043

[45] Date of Patent: Nov. 5, 1996

[54] MOBILE PLATFORM RECOVERY SYSTEM FOR BRIDGE MAINTENANCE

[75] Inventors: Gus G. Lyras, Lowellville; Steve G. Lyras, Campbell, both of Ohio

[73] Assignee: Corcon Industrial Painting, Lowellville, Ohio

[21] Appl. No.: 577,725

[22] Filed: Dec. 26, 1995

Related U.S. Application Data

[63] Continuation of Ser. No. 348,042, Dec. 1, 1994, abandoned.

[51] Int. Cl.[6] ..... B24C 9/60

[52] U.S. Cl. ..... 451/87; 451/88; 451/434; 451/453

[58] Field of Search ..... 451/75, 87, 88, 451/92, 434, 453; 224/309; 182/222, 129

[56] References Cited

U.S. PATENT DOCUMENTS 1,773,374 8/1930 Ruemelin .
4,852,307 8/1989 Goudeau .
5,011,710 4/1991 Harrison .
5,261,192 11/1993 Nelson ..... 451/88
5,269,424 12/1993 Lyras ..... 451/88
5,291,695 3/1994 Healy et al. .

*Primary Examiner*—D. S. Meislin
*Assistant Examiner*—Eileen P. Morgan
*Attorney, Agent, or Firm*—Harpman & Harpman

[57] ABSTRACT

A self-contained mobile painting and maintenance platform for recovery of steel grit blast media used in the pressurized cleaning of bridge structures prior to repainting. The painting and maintenance platform is positioned on vehicle with deck extensions that expand to form a large barrier free support and recovery surface and collection troughs to recover spent grit and shot via independent auger systems within the troughs.

8 Claims, 4 Drawing Sheets

MOBILE PLATFORM RECOVERY SYSTEM FOR BRIDGE MAINTENANCE

This is a Continuation application of Ser. No. 08/348,042, filed Dec. 1, 1994 now abandoned.

BACKGROUND OF THE INVENTION

1. Technical Field

This device relates to collection and recovery systems used in sandblasting and related blast fields in which collection structures are used to gather and remove accumulation of spent blast material at the work site for reprocessing or disposal.

2. Description of Prior Art

Prior art devices of this type have been used in the field of sandblasting and related abrasive blast cleaning used to clean steel super structures of bridges and the like to address the critical problem of spent abrasive accumulation at the site and in the environment. Government standards now dictate that all such spent material be recovered before it enters the environment and be removed from the site for reprocessing or other approved disposal methods. Prior art patents directed to this problem rely on trays and other flexible materials to be suspended from frames below the work site forming a collection funnel and trough into which the used contaminated blast media falls for recycling. Examples of such can be seen in U.S. Pat. Nos. 5,291,695, 5,011,710, 4,852,307, 1,773,374 and commercial applications of a platform recovery system shown in an advertising brochure entitled "ARK Systems, Inc.".

In U.S. Pat. No. 5,291,695 a scaffolding with enclosed movable work areas sealed against work surfaces is disclosed in which a scaffolding in this instance is adapted to be positioned about a elevated tank structure.

U.S. Pat. No. 5,011,710 is directed to a bridge maintenance method and equipment in which a method and structure is disclosed by which a collection containment area is suspended from below a bridge which collects spent contaminated blast media in an enclosure having multiple funnels extending to a vacuum conduit.

In U.S. Pat. No. 4,852,307 a system for retrieving sandblast cuttings is disclosed in which a flexible funnel configuration is formed from flexible material positioned over a frame configuration in a typical funnel shape. Multiple funnels can be positioned together for extended area of recovery.

U.S. Pat. No. 1,773,374 is directed to an adjustable portable folding sandblast cabinet for use in the collection and retention of sandblast material used in the configuring of grave markers, such as tombstones. The device shows a funnel configuration formed of a flexible material supported by two spaced support elements and then extending over and adjacent the work area.

Referring to reference A1 a brochure from ARK Systems, Inc. is illustrated showing rigid glass media collection troughs and structures which can be trucked to a site and hung or positioned below a work area for the collection of spent media through a grading floor surface into a trough having an auger system. The ARK platforms are self-contained and can be ganged together in multiple configurations as seen on page 3 of the brochure to form a large work recovery surface.

SUMMARY OF THE INVENTION

A portable self-contained staging and collection extensible platform system for the recovery of abrasive media used in air pressure blasting of steel super structures to remove rust and paint prior to repainting. The staging collection platform system deploys on site to form two independent recovery troughs and a barrier free porous support deck for the workers.

DESCRIPTION OF THE PREFERRED EMBODIMENTS

Figure 1:
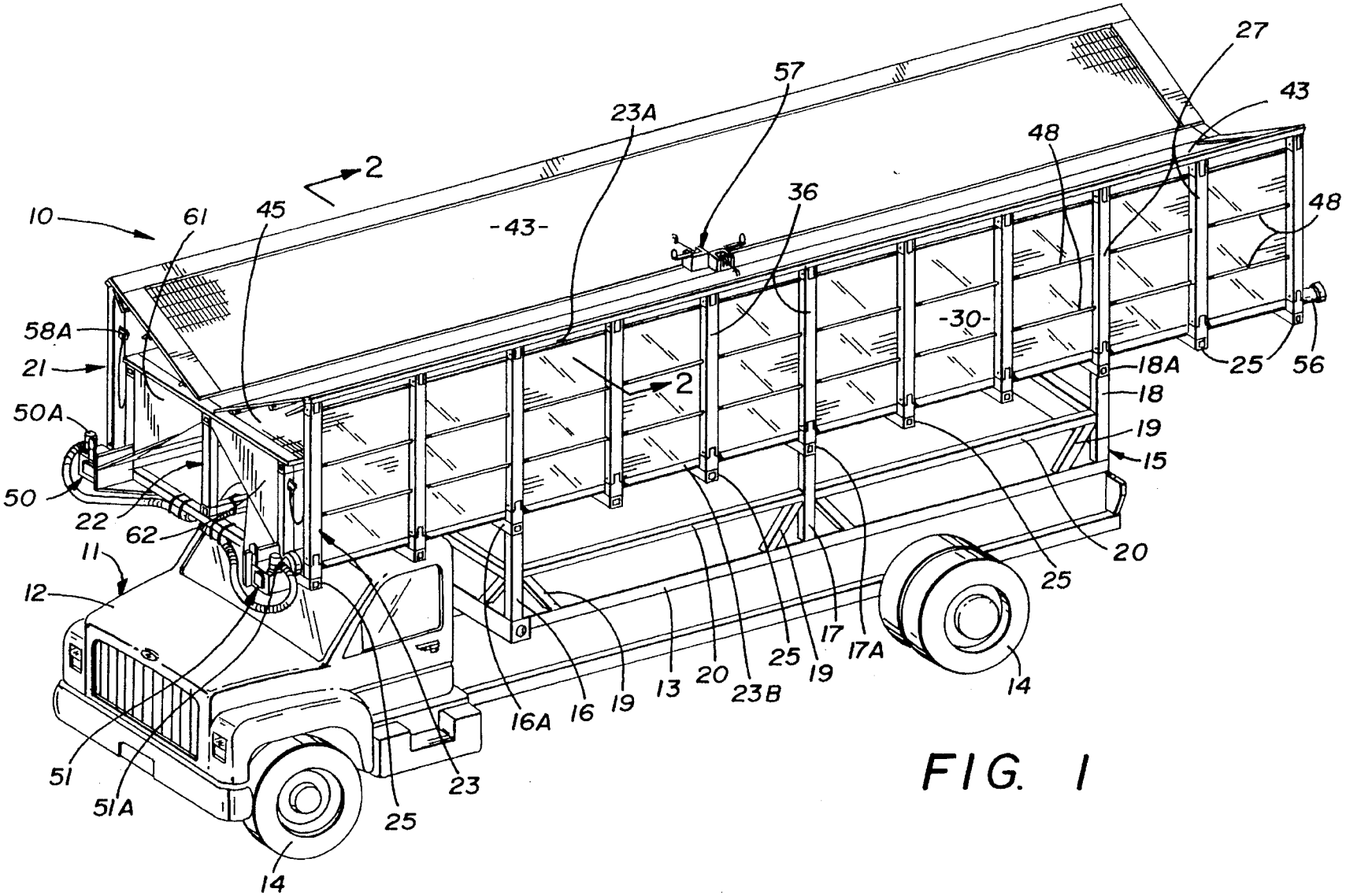
FIG. 1 is a perspective view of the mobile blast recovery platform on a vehicle.

Referring to FIG. 1 of the drawings a mobile containment platform 10 can be seen mounted on a vehicle shown in broken lines having a cab 12, a cargo bed 13 and multiple wheel assemblies 14. The mobile blast containment platform 10 has a support frame 15 defined by three pairs of longitudinally spaced opposing support posts 16, 17 and 18 extending from the vehicles cargo bed 13. Angular support elements 19 extend from the respective support posts to the vehicle's cargo bed 13 as will be well understood by those skilled in the art.

Figure 2:
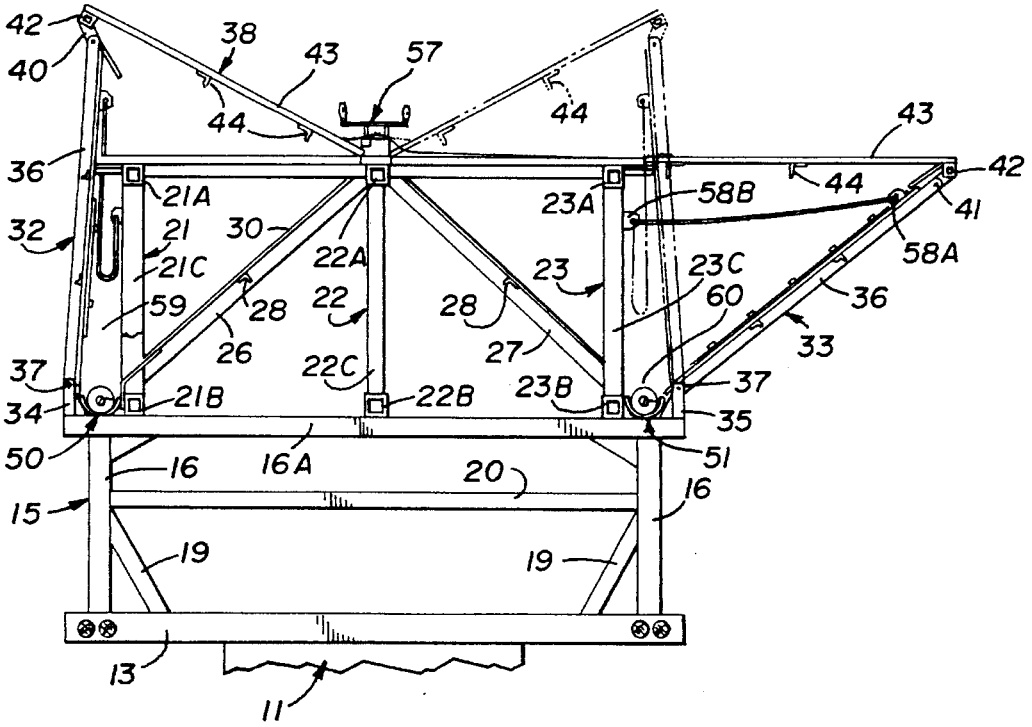
FIG. 2 is a front plan view thereof.
Figure 6:
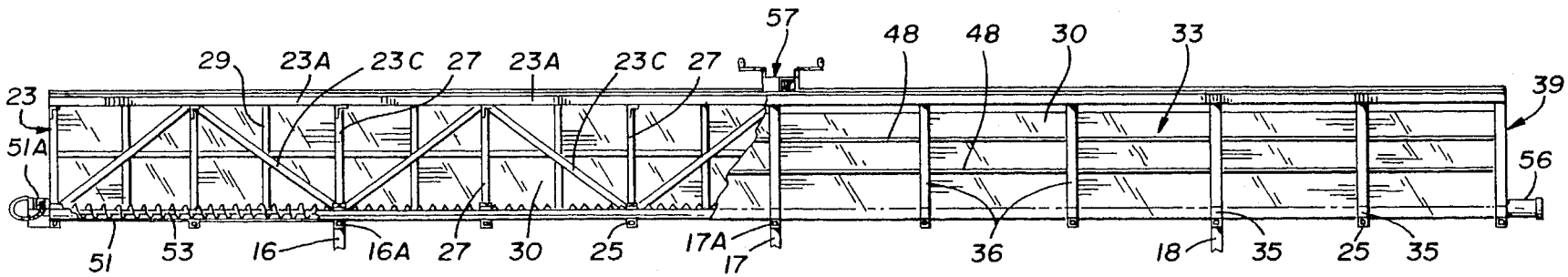
FIG. 6 is a side elevational view of the invention in deployed position.

Support beams 16A, 17A and 18A extend between the respective support posts pairs defining respective post and beam assemblies which are interconnected to one another by horizontally disposed longitudinally extending tie elements 20. Multiple support truss assemblies 21, 22, and 23 are positioned in spaced parallel relation to one another on the support frame's post and beam assemblies as best seen in FIGS. 1, 2 and 6 of the drawings. Each of the main support truss assemblies has upper and lower cords 21A and B, 22A and B and 23A and B with angularly disposed cord interconnecting elements 21C, 22C and 23C as is typical in a truss configuration.

The support truss have additional transversely extending truss connecting elements 25 secured to the respective truss' lower cords 21B, 22B and 23B in spaced relation together to form a structural cohesive configuration.

Figure 3:
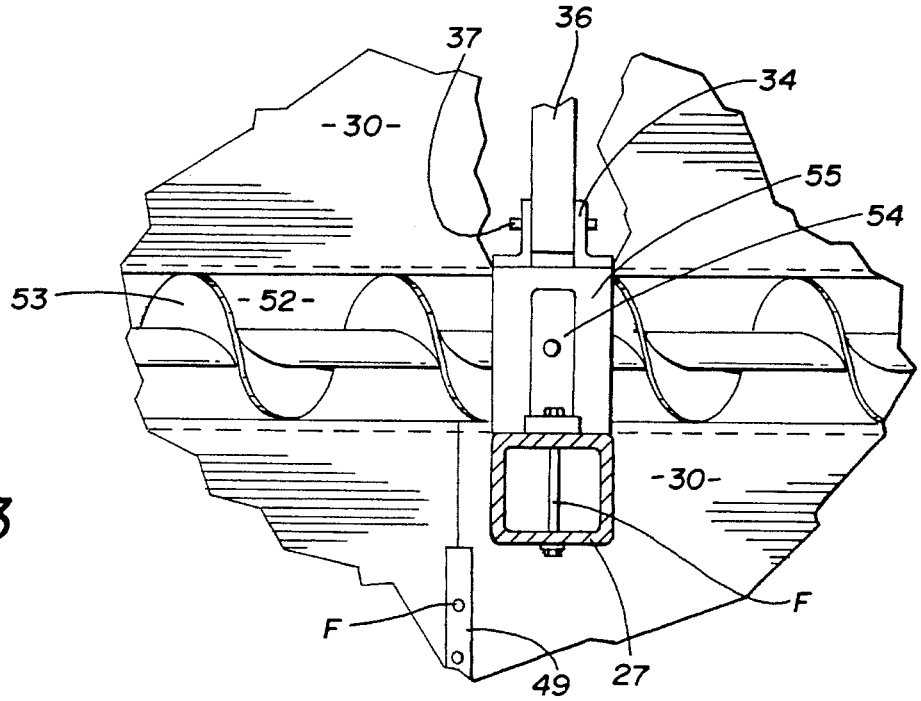
FIG. 3 is a rear plan view thereof.
Figure 4:
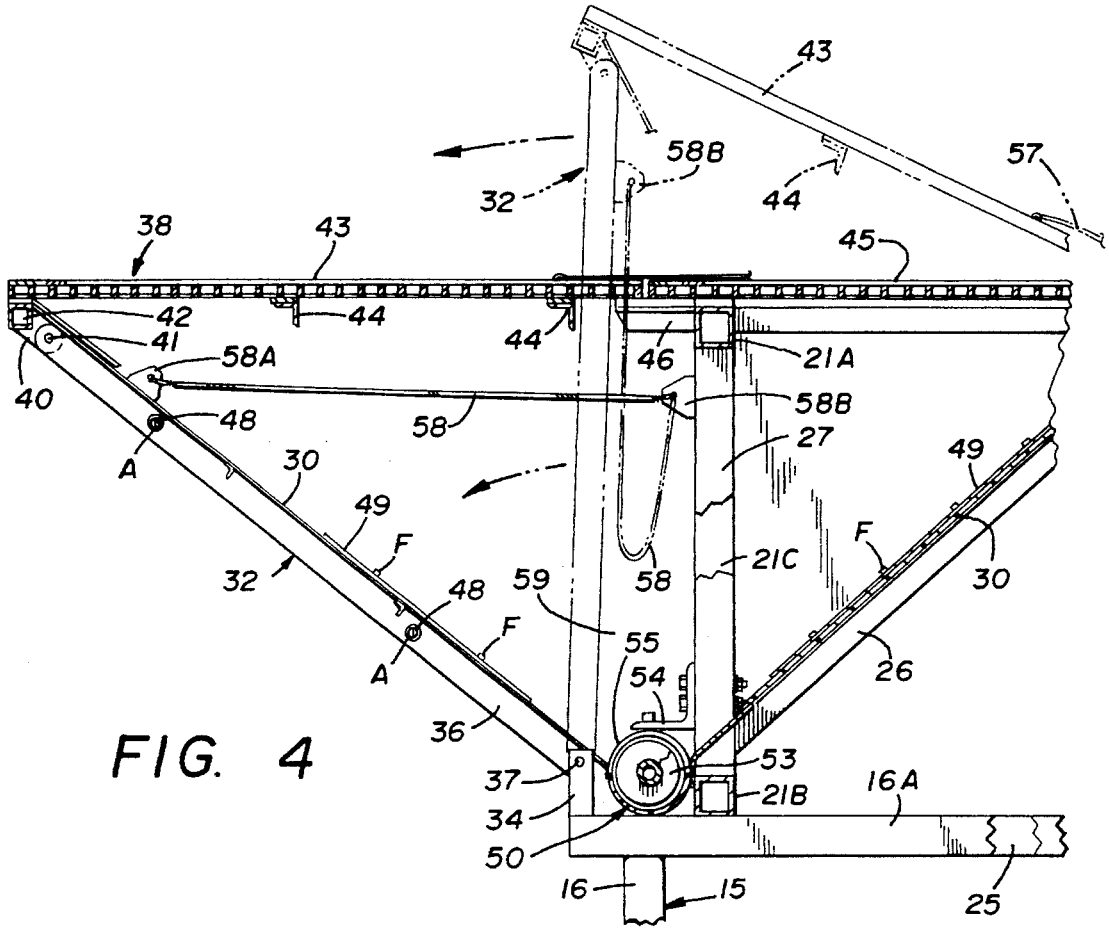
FIG. 4 is an enlarged front plan view of the recovery platform with portions shown in broken lines.
Figure 7:
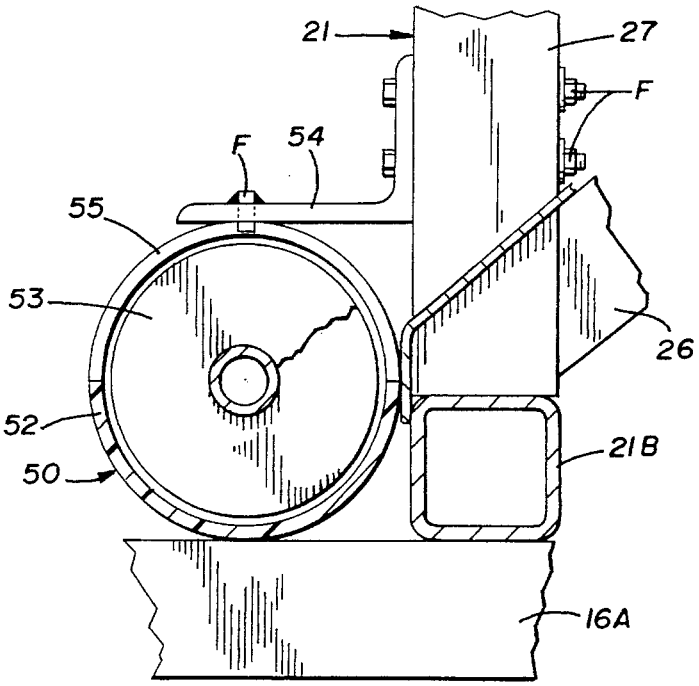
FIG. 7 is an enlarged view of an auger assembly of FIG. 4.

Referring to FIGS. 2–4 of the drawings a plurality of longitudinally spaced angularly aligned wall support frame elements 26 and 27 can be seen extending between said respective lower cords 21B and 23B of the truss 22 and 23 to the upper cord 22A of the truss 22.

Wall panel mounting support angle irons 28 interconnect the respective aligned wall support frame elements 26 with one another and respective frame elements 27 with one another with secondary angularly aligned wall panel mounting support elements 29 extending therebetween.

Panels 30 of synthetic resin material are secured to the respective wall support frame elements 26 and wall support frame elements 27 and associated interconnecting wall panel mounting support angles 28 and 29 as hereinbefore described to form oppositely disposed collection wall surfaces between the respective truss assemblies 21, 22, and 23.

Referring now to FIGS. 1–5 of the drawings, a pair of identically oppositely disposed movable deck and wall assemblies 32 and 33 can be seen extending from the main support frame 15 on respective multiple elongated spaced upstanding pivot support elements 34 and 35. Each of the deck and wall assemblies 32 and 33 has multiple main support ribs 36 pivotally secured to their respective pivoted support elements 34 and 35 by pivot pins 37. Deck support frame assemblies 38 and 39 are pivotally secured to the respective free ends of said main support ribs 36 by multiple apertured support links 40 through which pivot pins 41 extend as best seen in FIG. 4 of the drawings. The deck support frame assemblies 38 and 39 each have an elongated support edge member 42 interconnecting the longitudinally spaced main support ribs 36 on each of respective deck and wall assemblies 32 and 33 from which is secured grating sections 43 having spaced support angles 44 secured to their lower surfaces.

Figure 5:
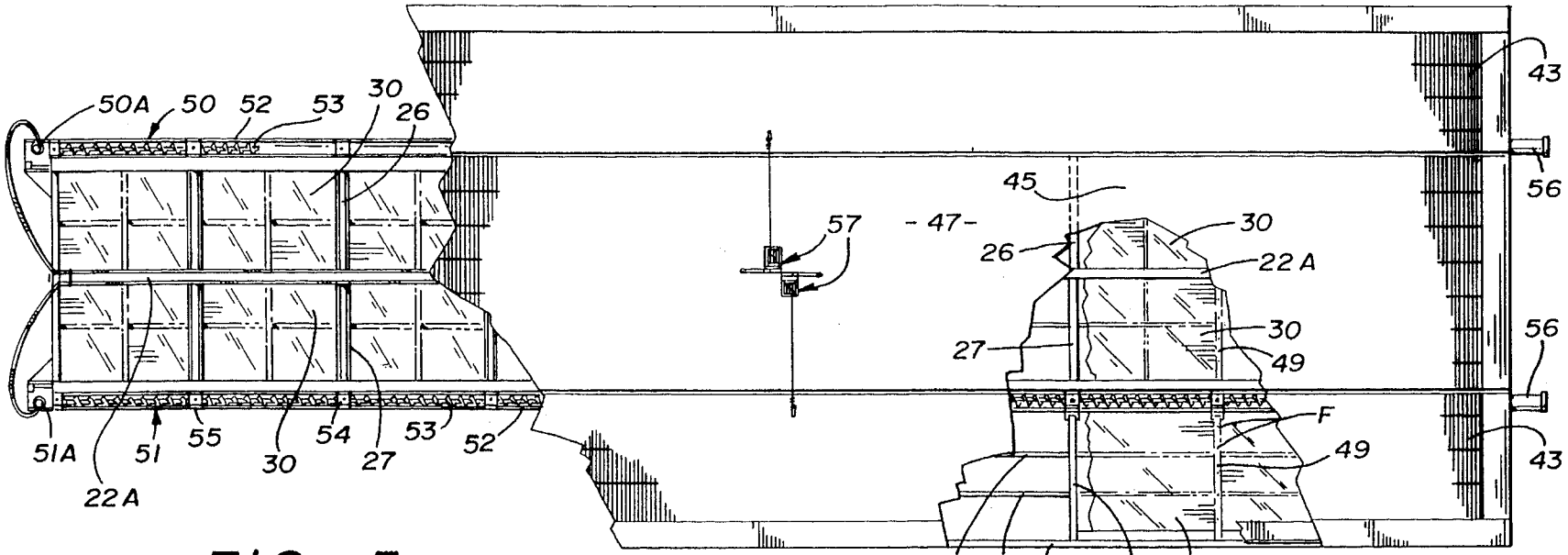
FIG. 5 is a top plan view of the invention with portions broken away.

Referring now to FIGS. 2, 4, and 5 of the drawings, center grating sections 45 can be seen secured to the respective upper cords 21A, 22A and 23A of the truss overlapping the oppositely disposed perimeter edges of the truss cords 21A, 23A onto an edge extension 46 as best seen in FIG. 4 of the drawings. After deck and wall assemblies 32 and 33 deployment the deck grating 43 rests on and is supported by the edge extension 46 so as to form a continuous barrier free working deck containment platform surface 47 generally illustrated in FIG. 5 of the drawings.

Each of the wall support ribs 36 have aligned multiple apertures A therein through which tie rods 48 extend and to which they are secured.

Panels 30 of synthetic resin material are additionally secured over the respective wall support ribs 36 by utilizing apertured compression mounting strips 49 and secured thereto by respective multiple fasteners F, best seen in FIG. 4 of the drawings.

Referring now to FIGS. 4–7 of the drawings, a pair of material auger assemblies 50 and 51 can be seen positioned between the upstanding pivot support elements 34 and 35 and respective pivot edge truss' 21 and 23. Each material auger assembly has a transport trough 52 with a continuous spiral screw 53 positioned therein. The spiral screw 53 has a single continuous spiral flight that are driven respectively by drive motors 50A and 51A best seen in FIGS. 5 and 6 of the drawings. The material auger assemblies 50 and 51 are secured to the respective truss elements 21 and 23 by multiple mounting brackets 54 extending therefrom which are engageable on an upstanding arcuate portion 55 of the transportation trough 51 best seen in FIG. 7 of the drawings.

The transportation trough 52 extend the length of the respective truss assemblies 21 and 23 exiting opposite the respective drive motors 50A and 51A as transport tubes 56 from which the collected spent blast material is removed as is well known and understood by those skilled in the art.

It will be evident from the above description that in use the mobile platform recovery system vehicle 11 is positioned under the work area such as a bridge structure (not shown). The opposing deck and wall assemblies 32 and 33 are extended from the main support frame 15 via cable and winch assemblies 57 as seen in FIG. 1 of the drawings and are held at a pre-selected angle by respective restraint cables 58 between apertured mounting tabs 58 A and B extending from the main support ribs 36 and support trusses 21 and 23 respectively. The deployed deck and wall assemblies 32 and 33 thus forms two parallel collection areas 59 and 60 between the hereinbefore described wall surfaces formed by the respective wall support frame elements 26 extending between the truss assemblies 21 and 22 and the wall surface formed by the wall support frame elements 27 extending between the truss assemblies 22 and 23.

As spent blast material (not shown) falls from the work area, it passes through the respective grating sections 43 and 44 of the containment platform surface 47 into the collection areas 59 and 60 and associated transport auger assemblies 50 and 51.

To achieve complete containment of the spent blast material in the platform and recovery system, flexible end covers 61 and 62 are secured at the open ends of their respective containment areas 59 and 60 between the respective truss assemblies 21 and 22 and 23 and 22 as best seen in FIG. 1 of the drawings.

After use, the continuous barrier free working deck containment platform surface 47 formed by the grading sections 43 and 44 can be configured for transport mode by retraction of the respective deck and wall assemblies 32 and 33 via the cable and winch assemblies 57 as illustrated in FIGS. 1, 2 and 4 of the drawings.

Thus it will be seen that a self-contained mobile platform recovery system for bridge maintenance and the like has been illustrated and described and it will be apparent to those skilled in the art that various changes and modifications may be made therein without departing from the spirit of the invention.

Therefore we claim:

1. A work platform assembly mounted on a vehicle, said assembly comprising:

a support frame attached to the vehicle;

a platform attached to the support frame, the platform having a grating on a deck, a portion of the deck being movable;

a collection area beneath said grating, the collection area having a wall assembly extending from said support frame and said platform;

a conveyor through in said collection area; and a movable conveyor in said conveyor trough, the conveyor assembly including a drive motor.

2. A work platform assembly as in claim 1, said assembly further comprising a crank for manipulating said movable portion of the deck.

3. A work platform assembly as in claim 2, wherein the wall assembly of the collection area comprises a panel, the wall assembly being pivotally attached to the support frame and attached to the movable deck portion.

4. A work platform assembly as in claim 1, wherein the movable conveyor is an auger.

5. A work platform assembly mounted on a vehicle, said assembly comprising:

a support frame attached to the vehicle, the support frame having trusses attached to the vehicle;

a platform attached to the support frame, the platform having a grating on a deck, the deck having a length in the direction extending longitudinally of the vehicle, and a width in the direction extending laterally of the vehicle, the deck having at least two portions, the first portion of the deck being secured to the support frame trusses and the second portion of the deck being movable;

a collection area beneath said grating, the collection area having a wall assembly extending between said support frame and said platform;

a conveyor trough in said collection areas; and a movable conveyor in said conveyor trough, the conveyor assembly including a drive motor.

6. A work platform assembly as in claim 5, said assembly further comprising a crank for manipulating said second portion of the deck.

7. A work platform assembly as in claim 5, wherein the movable conveyor is an auger.

8. A work platform assembly as in claim 5, wherein the wall assembly of the collection area comprises a panel, the wall assembly being pivotally attached to the support frame and attached to the second portion of the deck.

* * * * *